US006203475B1

(12) United States Patent
Plamann

(10) Patent No.: US 6,203,475 B1
(45) Date of Patent: Mar. 20, 2001

(54) WEIGHT LIGHTING MACHINE

(76) Inventor: Kenneth O. Plamann, 3105 E. Broadway Dr., Appleton, WI (US) 54915

( * ) Notice: Subject to any disclaimer, the term of this patent is extended or adjusted under 35 U.S.C. 154(b) by 0 days.

(21) Appl. No.: 09/490,037

(22) Filed: Jan. 24, 2000

Related U.S. Application Data

(62) Division of application No. 09/231,623, filed on Jan. 19, 1999.

(51) Int. Cl.[7] ..... A63D 21/06
(52) U.S. Cl. ..... 482/100; 482/137
(58) Field of Search ..... 482/97, 100, 129, 482/130, 136, 137, 905

(56) References Cited

U.S. PATENT DOCUMENTS 4,621,807 * 11/1986 Stramer ..... 482/100
4,846,468 * 7/1989 McCoy et al. ..... 482/905
4,902,006 * 2/1990 Stallings ..... 482/100
4,953,855 * 9/1990 Shields ..... 482/100
4,957,281 * 9/1990 Christolear ..... 482/100
5,067,708 * 11/1991 Oschansky et al. ..... 482/100
5,074,551 * 12/1991 Olschansky et al. ..... 482/137

* cited by examiner

*Primary Examiner*—John Mulcahy
(74) *Attorney, Agent, or Firm*—Donald Cayen

(57) ABSTRACT

A weight lifting machine is useful for developing muscles used in arm wrestling. The weight lifting machines comprises a carrier that rotates about an axis of rotation. Pivotable levers are connected to the carrier symmetrical about the axis of rotation. A cord hangs from each lever. The cords join into a single cord that holds a weight so as to produce equal and opposite torques on the carrier. A person exerts a force on the carrier sufficient to overcome one of the torques and thereby rotate the carrier. By pivoting the levers the cords hang at different distances from the carrier axis of rotation, thereby changing the amount of torque produced on the carrier by the weight and the amount of force the person must exert to rotate the carrier. A block on the carrier contacts the cord during carrier rotation in a manner that results in a smooth and continuous resistance by the weight on the person's arm.

7 Claims, 6 Drawing Sheets

WEIGHT LIGHTING MACHINE

This application is a division of U.S. patent application Ser. No. 09/231,623 filed Jan. 19, 1999.

BACKGROUND OF THE INVENTION

1. Field of the Invention

This invention pertains to exercising apparatus, and more particularly to machines for developing arm strength.

2. Description of the Prior Art

Various types of equipment have been developed to assist persons strengthen their muscles. For example, machines for developing arm muscles are well known and in widespread use. U.S. Pat. Nos. 3,042,023; 4,239,210; and 5,256,125 show machines that are useful for developing a person's biceps.

Arm muscles in addition to biceps are important in the sport of arm wrestling. In that sport, the competitors' elbows are placed side-by-side on a horizontal surface with the forearms vertical. Each person attempts to pivot his arm at the elbow across the front of his torso. To pivot his arm, he must overcome the resisting force exerted by the other contestant.

To develop the muscles used in arm wrestling, a person can lift a weight as he pivots his arm. U.S. Pat. No. 3,019,019 and U.S. Pat. No. Des. 264,236 disclose suitable weight lifting apparatus. U.S. Pat. Nos. 4,634,115 and 5,458,554 show machines in which springs provide the resistance to arm pivoting.

A disadvantage of the prior weight and spring related machines is that the resisting forces can be adjusted only in course increments. Further, the resisting forces of the machines of the U.S. Pat. No. Des. 264,236; U.S. Pat. Nos. 4,634,115; and 5,458,554 patents are not uniform over the range of arm motion.

Thus, a need exists for improvements in arm wrestling exercise machines.

SUMMARY OF THE INVENTION

In accordance with the present invention, a weight lifting machine provides fine adjustability to a resisting force that must be overcome during operation. This is accomplished by apparatus that includes pivotable levers that vary the torque required to rotate a carrier and lift a weight.

The levers are connected to the carrier for pivoting about respective axis. Each lever has an arcuate surface, to which is secured one end of a cord. The two cords hang from the respective arcuate surfaces and merge below the carrier to form a single cord that holds the weight.

A shaft connected to the carrier is supported in bearings that rotate the carrier about an axis of rotation. A hand grip and elbow pad rotate with the shaft and carrier. The levers are symmetrical about the carrier axis of rotation.

In a first position, the levers are generally vertical, and their arcuate surfaces are generally vertical. In that position, the distance of the lever arcuate surfaces, and thus the distances of the cords, from the carrier axis of rotation is at a minimum. The weight acting on the two cords produces equal and opposite minimum torques on the carrier.

The levers are pivotable to a second position by means of a slide that is movable on the carrier. When the slide is at a first location, the levers are in their first position. Moving the slide toward a second location on the carrier causes the levers to pivot about their respective axes such that their arcuate surfaces acquire a more horizontal attitude. The cords then hang from the levers at a greater distance from the carrier axis of rotation than when the levers are in their first position. The weight acting through the cords then produces equal and opposite second torques on the carrier greater than the torques produced when the levers are in their first position.

There is a block with an arcuate surface on the slide below the levers. The block arcuate surface lies in a generally horizontal plane. The block arcuate surface is a continuation of the arcuate surfaces of the levers when the slide is in the first location thereof and the levers are in their first position.

To use the weight lifting machine of the invention, a user adjusts the levers by moving the slide on the carrier such that the cords produce the desired amount of torque on the carrier. He places an elbow on the pad and grasps the hand grip. He exerts a force on the hand grip sufficient to rotate the carrier a slight amount about the axis of rotation. Rotating the carrier causes the levers to revolve about the axis of rotation such that one lever attains a higher elevation and the other a lower elevation relative to the axis of rotation. The cord secured to the lever that attains the higher elevation is pulled by that lever to carry the entire force of the weight and thereby provide resistance to the force exerted by the user's arm. That cord maintains contact with the arcuate surface of the associated lever and also contacts the arcuate surface of the slide block as the carrier rotates. The cord secured to the lever that attains the lower elevation becomes slack.

The slide is movable in small increments on the carrier. Accordingly, the levers are also pivotable between the first and second positions in small increments. Consequently, the force the user must exert to lift the weight is adjustable in small increments. The block moves with the slide such that the block arcuate surface contacts the cord that is secured to the lever that attains the higher elevation during carrier rotation. The block arcuate surface is located relative to the carrier axis of rotation and to the levers such that the weight is lifted by the cord at a constant speed relative to the speed of carrier rotation. The result is a smooth and continuous resisting force on the user's arm.

The method and apparatus of the invention, using pivotable arms with arcuate surfaces to which weight-holding cords are secured, thus enables a person to strengthen the muscles used in arm wrestling. The force required to be exerted by the person is adjustable over a wide range and in small increments, even though only one weight is used in the machine.

Other advantages, benefits, and features of the present invention will become apparent to those skilled in the art upon reading the detailed description of the invention.

DETAILED DESCRIPTION OF THE PREFERRED EMBODIMENT

Figure 1:
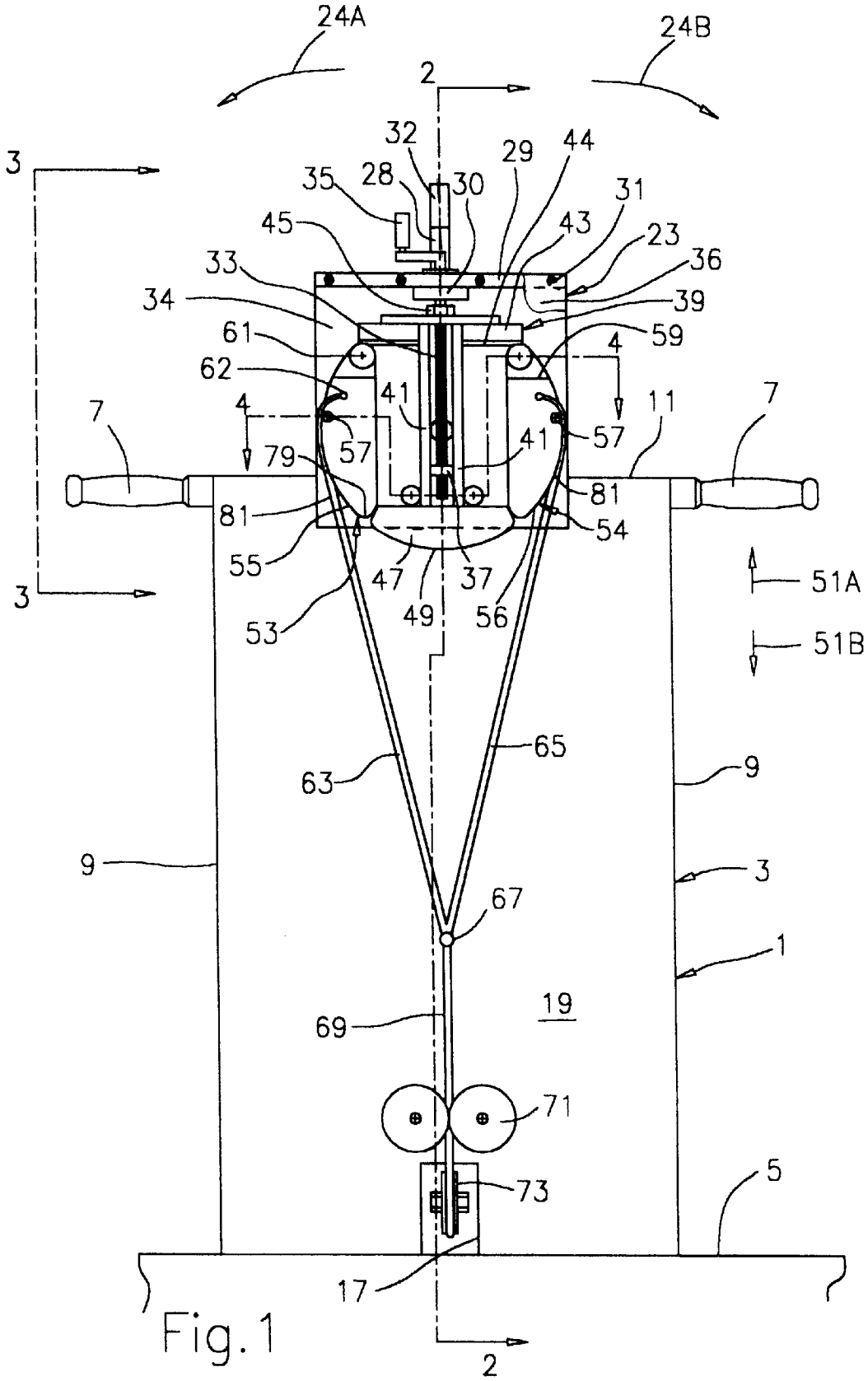
FIG. 1 is a broken front view of the weight lifting machine of the present invention.
Figure 2:
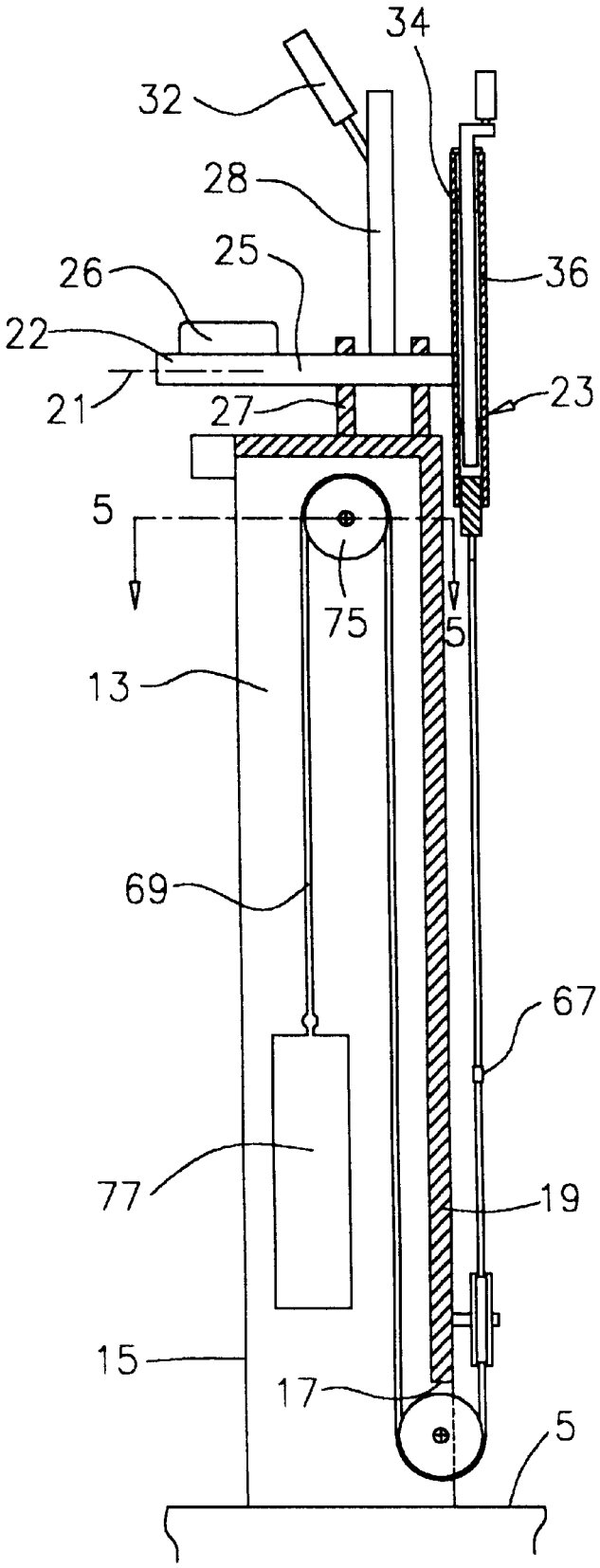
FIG. 2 is a cross sectional view on an enlarged scale taken along line 2—2 of FIG. 1.
Figure 3:
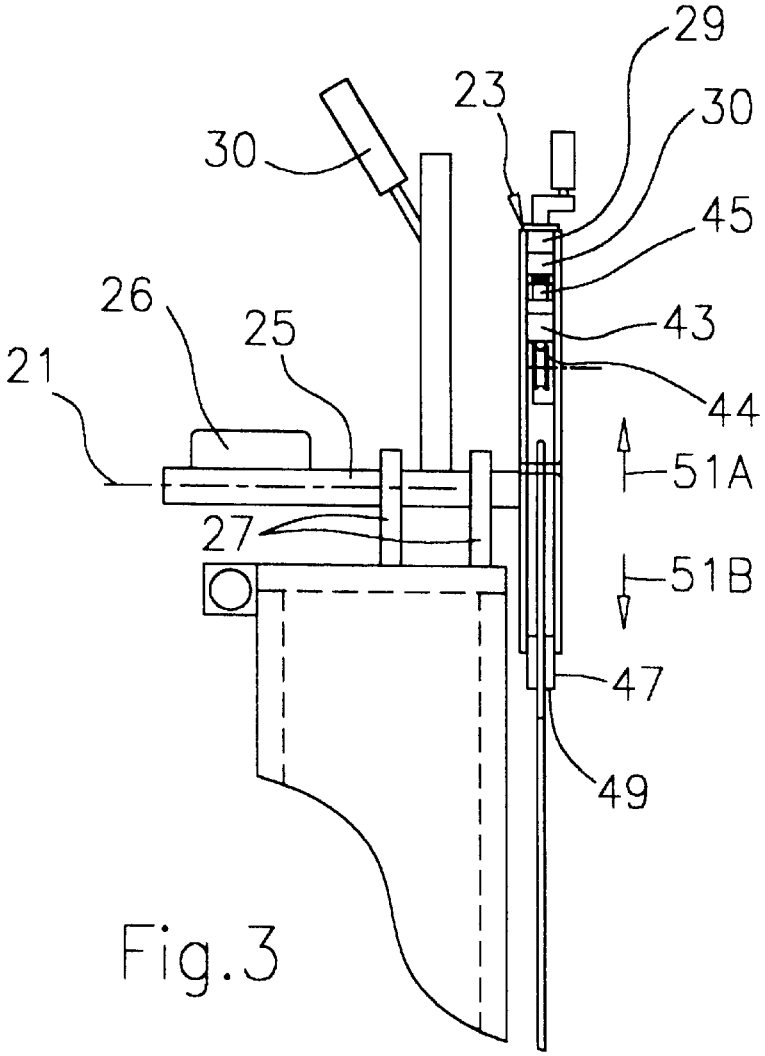
FIG. 3 is a view on an enlarged scale taken along line 3—3 of FIG. 1.
Figure 5:
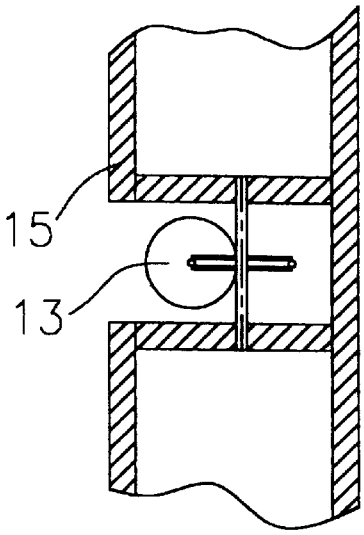
FIG. 5 is a cross sectional view taken along line 5—5 of FIG. 2.
Figure 4:
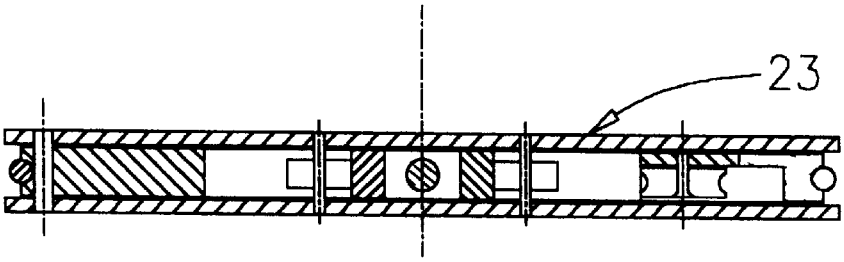
FIG. 4 is a cross sectional view on an enlarged scale taken along line 4—4 of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring first to FIGS. 1–5, a weight lifting machine 1 is illustrated that includes the present invention. The weight lifting machine 1 is particularly useful for strengthening a person's muscles that are used in the sport of arm wrestling. However, it will be understood that the invention is not limited to competition related activities.

The weight lifting machine 1 is comprised of a stand 3 that rests on a floor 5. A preferred height for the stand 3 is approximately 40 inches. A width of approximately 24 inches and a depth of approximately eight inches are satisfactory. The stand can be made of any suitable material, such as wood. A pair of handles 7 protrude in opposite directions from the stand sides 9 at the stand top surface 11. The stand has a hollow central region 13 in the back wall 15. There is an opening 17 through the stand front wall 19 near the floor 5. The opening 17 extends into the hollow central region 13.

Mounted on the stand top surface 11 for rotation about a horizontal axis 21 is a vertically oriented carrier 23. In the preferred embodiment, the carrier 23 is comprised of a back plate 34, a front plate 36 parallel to and spaced from the back plate, and a cross bar 29 between the top ends of the front and back plates. The back plate 34, front plate 36, and cross bar 29 are fastened together with conventional fasteners 31. For clarity, the front plate is shown partially broken away in FIG. 1. The carrier is rotatable in the directions of arrows 24A and 24B by means of a shaft 25 that is fixed to the back plate 34. The shaft 25 is supported in bearing lugs 27. An extension 22 on the shaft 25 holds a soft pad 26. A post 28 with a hand grip 32 upstands from the shaft.

The carrier cross bar 29 supports a bearing 30. In turn, the bearing 30 rotatably supports the upper end of a vertical screw 33. A crank 35 is connected to the upper end of the screw 33 such that turning the crank turns the screw.

A nut 37 engages the screw 33. The nut 37 is part of a generally T-shaped slide 39. The slide 39 includes two long guide plates 41 that are attached to the nut and that are slidable between the carrier plates 34 and 36. A cross piece 43 connects to the upper ends of the guide plates 41. There is a horizontal semi-circular guide 44 on the underside of the cross piece 43. A bushing 45 on the cross piece 43 fits over the screw 33 to help guide the slide in the carrier 23. On the lower end of the guide plates is a block 47. The block 47 has a convex arcuate surface 49 at a radius from the axis of rotation 21. As mentioned, turning the crank 35 turns the screw. Accordingly, turning the crank causes the slide to move in the carrier in the directions of arrows 51A and 51B.

Pivotally connected to the carrier 23 on opposite sides of the slide 39 are a pair of symmetrical levers 53 and 54. The levers 53 and 54 have respective convex arcuate surfaces 55 and 56 that have the same radius as the arcuate surface 49 of the block 47. The levers are pivotally connected to the carrier plates 34 and 36 by respective pins 57. One end of each lever is notched at reference numeral 59. A roller 61 is assembled in the notch 59 of each lever. The rollers 61 contact the guide 44 on the slide cross piece 43.

Secured in the lever 53 is the first end 62 of a cord 63. A similar cord 65 is secured to the lever 54. The cords 63 and 65 hang from the respective lever arcuate surfaces 55 and 56 and merge at a junction 67 below the carrier 23. From the junction 67, a single cord 69 is guided by side pulleys 71 under a bottom pulley 73 in the stand opening 17, and over a top pulley 75 in the stand hollow central region 13. The distal end of the cord 69 is tied to a weight 77. The weight 77, acting through the cords 69 and 63, tends to pivot the lever 53 about the pin 57 in a counterclockwise direction with respect to FIG. 1. The weight and cords 69 and 65 tend to pivot the lever 54 in a clockwise direction. Both levers are limited in their pivoting by contact of the ends 79 thereof with the block 47.

The weight 77 acting through the cords 63 and 69 produce a torque in the direction of arrow 24A on the carrier 23. The weight acting through the cords 65 and 69 produce an equal torque in the direction of arrow 24B on the carrier. The carrier is thus in an equilibrium position, FIG. 1. The amount of each of the equal and opposite torques is one-half of the product of the weight and the distance between the axis of rotation 21 and the lever arcuate surfaces 55 or 56. A weight of 30 pounds and a distance between the lever arcuate surfaces 55 and 56 of approximately 15 inches work very well.

Figure 6:
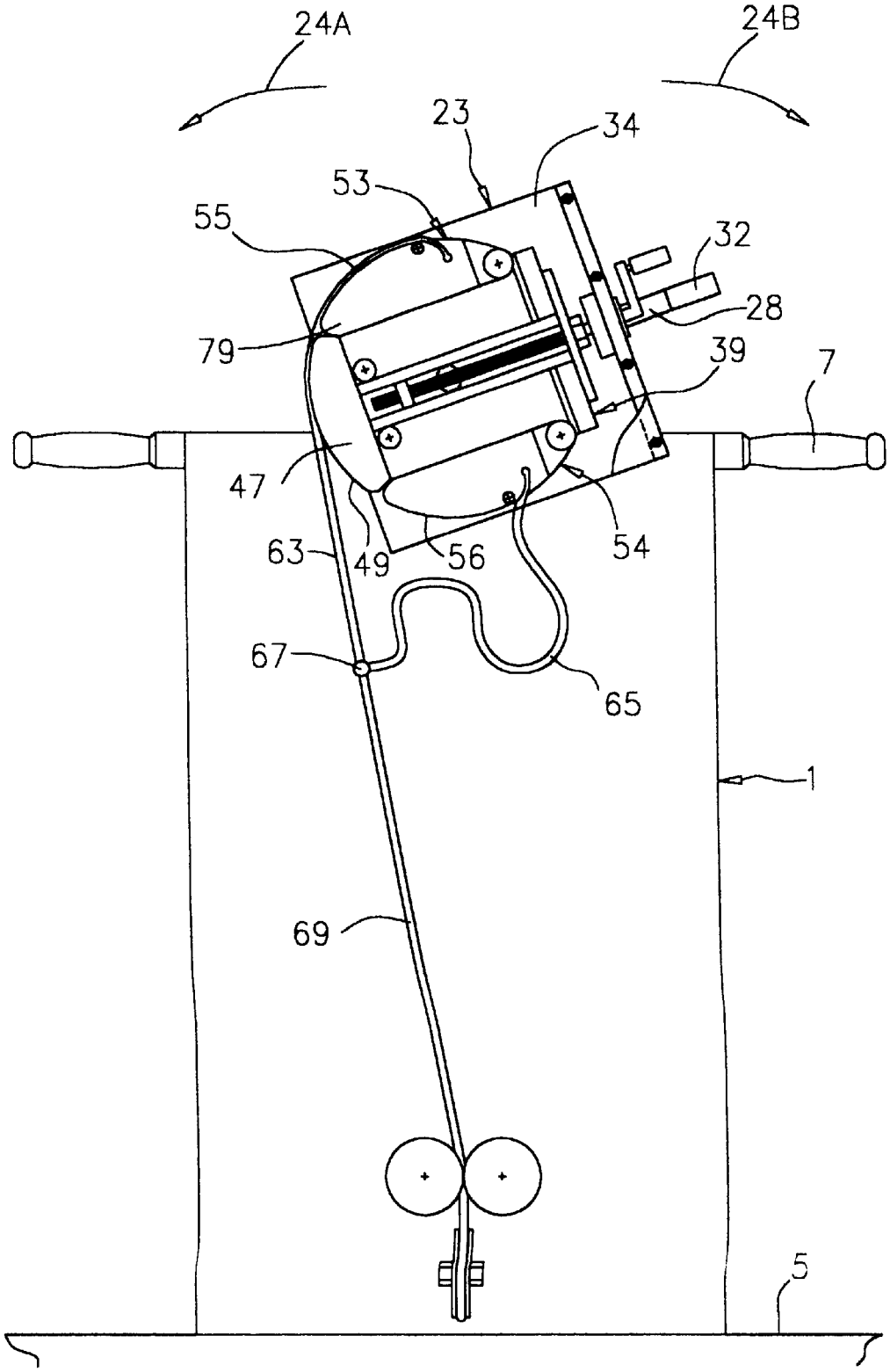
FIG. 6 is a broken front view of the weight lifting machine showing the machine in operation to lift a weight by exerting a minimum amount of force.

FIG. 6 shows the weight lifting machine 1 in operation. A user stands on the floor 5. He places the elbow of one arm on the pad 26 and grasps the hand grip 32. He can grasp a handle 7 with the other hand if desired. In the example shown in FIG. 6, the person exerts a force on the hand grip in the direction of arrow 24B. The exerted force is sufficient to rotate the carrier 23 slightly about the axis of rotation 21 in the direction of arrow 24B. The slide 39 and levers 53, 54 revolve with the carrier. As a result, the lever 53 acquires a higher elevation, and the lever 54 a lower elevation, compared to the equilibrium position of FIG. 1.

As the lever 53 revolves around the axis of rotation 21, the cord 63 is lifted. The cord 63 pulls the cord 69 and supports the entire force of the weight 77. The cord 65 between the lever 54 and the cord junction 67 becomes slack. The resisting torque that the user must overcome then equals the product of the force of the weight times the distance between the axis of rotation and the lever arcuate surface 55.

As the carrier 23 is rotated, the cord 63 comes into contact with the full arcuate surface 55 of the lever 53 between the cord end 62 and the lever end 79. The cord 63 also comes into contact around the arcuate surface 49 of the block 47. Accordingly, the cord makes a smooth transition between the lever and the block. The result is that the weight is lifted at a constant speed relative to the carrier rotation, eliminating any shock forces on the user's arm. Further, the resisting force of the weight remains constant throughout the rotation of the carrier. The force required to be exerted by the user's arm is therefore also a constant. After the carrier had been rotated the desired amount in the direction of arrow 24B, the user reduces the force he exerts on the hand grip 32. The carrier then rotates in the direction of arrow 24A under the resisting torque produced by the weight back to the equilibrium position of FIG. 1. The weight lifting machine 1 is then ready to undergo another cycle. By switching arms, the user rotates the carrier in the direction of arrow 24A to overcome the resisting torque of the weight 77 acting through the cords 65 and 69.

Figure 7:
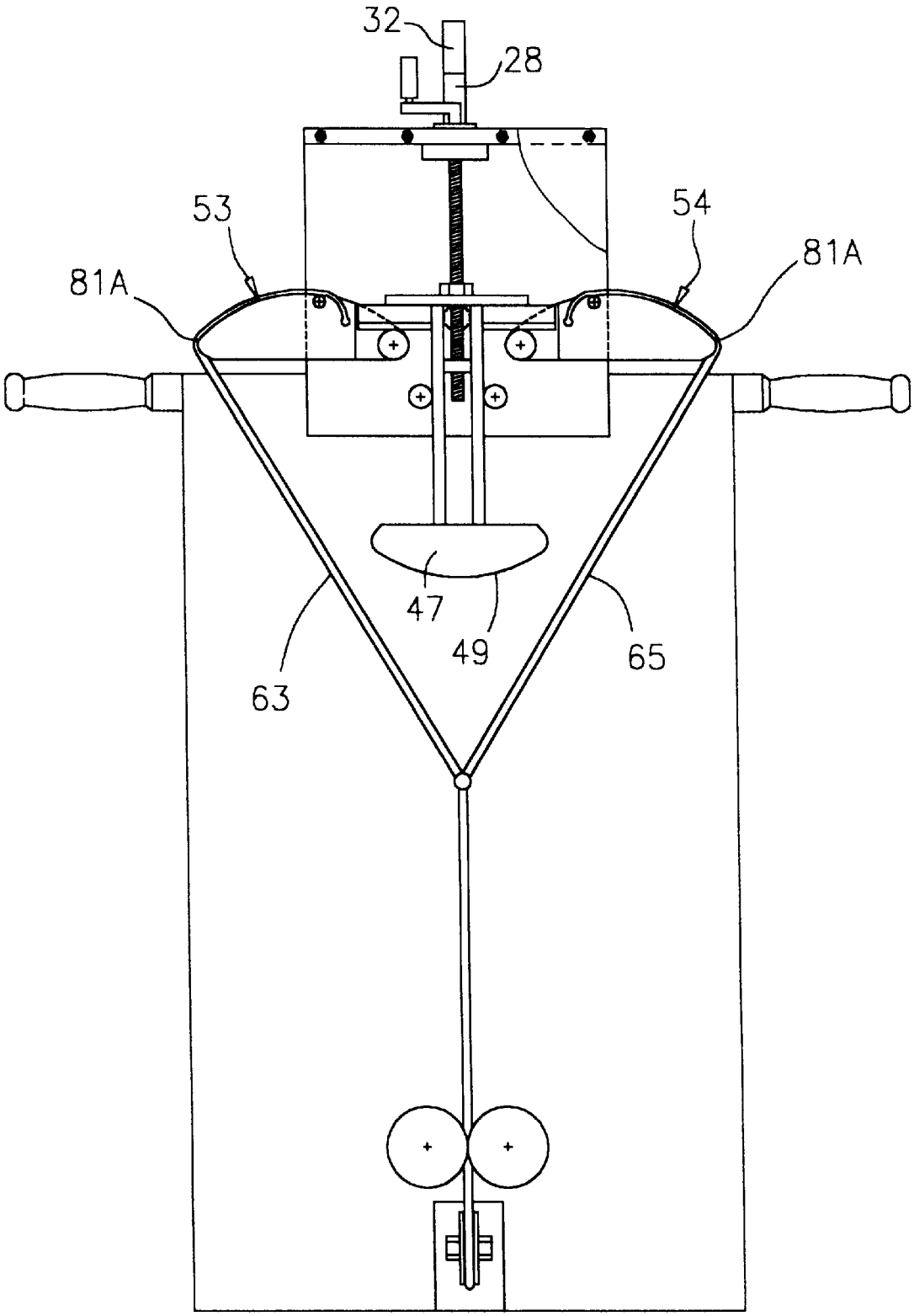
FIG. 7 is a view generally similar to FIG. 1, but showing the machine adjusted to a configuration that requires a maximum amount of force to be exerted to operate the machine.

In FIGS. 1–6, the levers 53 and 54 are in a position such that the distance between the axis of rotation 21 and the points 81 at which the cords 63 and 65 leave contact with the arcuate surfaces 55 and 56, respectively, is a minimum. In that situation, the user must exert a minimum force on the hand grip 32 to produce the force required to rotate the carrier 23. To increase the force the user must exert to rotate the carrier, the crank 35 is rotated to move the slide 39 in the direction of arrow 51B. The block 47 moves with the slide. The slide cross piece 43 contacts the lever rollers 61 and causes the levers to pivot about their respective pins 57, FIG. 7. That action increases the distance from the points 81A of contact of the cords 63, 65 with the levers 53, 54, respectively, and the axis of rotation 21. The slide and block are designed such that the block arcuate surface 49 is located at the same distance from the axis of rotation 21 as the points 81A.

Because the cords 63 and 65 hang from points 81A that are at an increased distance from the axis of rotation 21, the torque exerted on the carrier by the weight 77 increases proportionally relative to the minimum torque of FIGS. 1 and 6. The user must therefore exert an increased torque to rotate the carrier. Since the post 28, hand grip 32, and weight 77 do not change with a change in lever position, the user must exert an increased force on the hand grip to rotate the carrier and thereby lift the weight.

Figure 8:
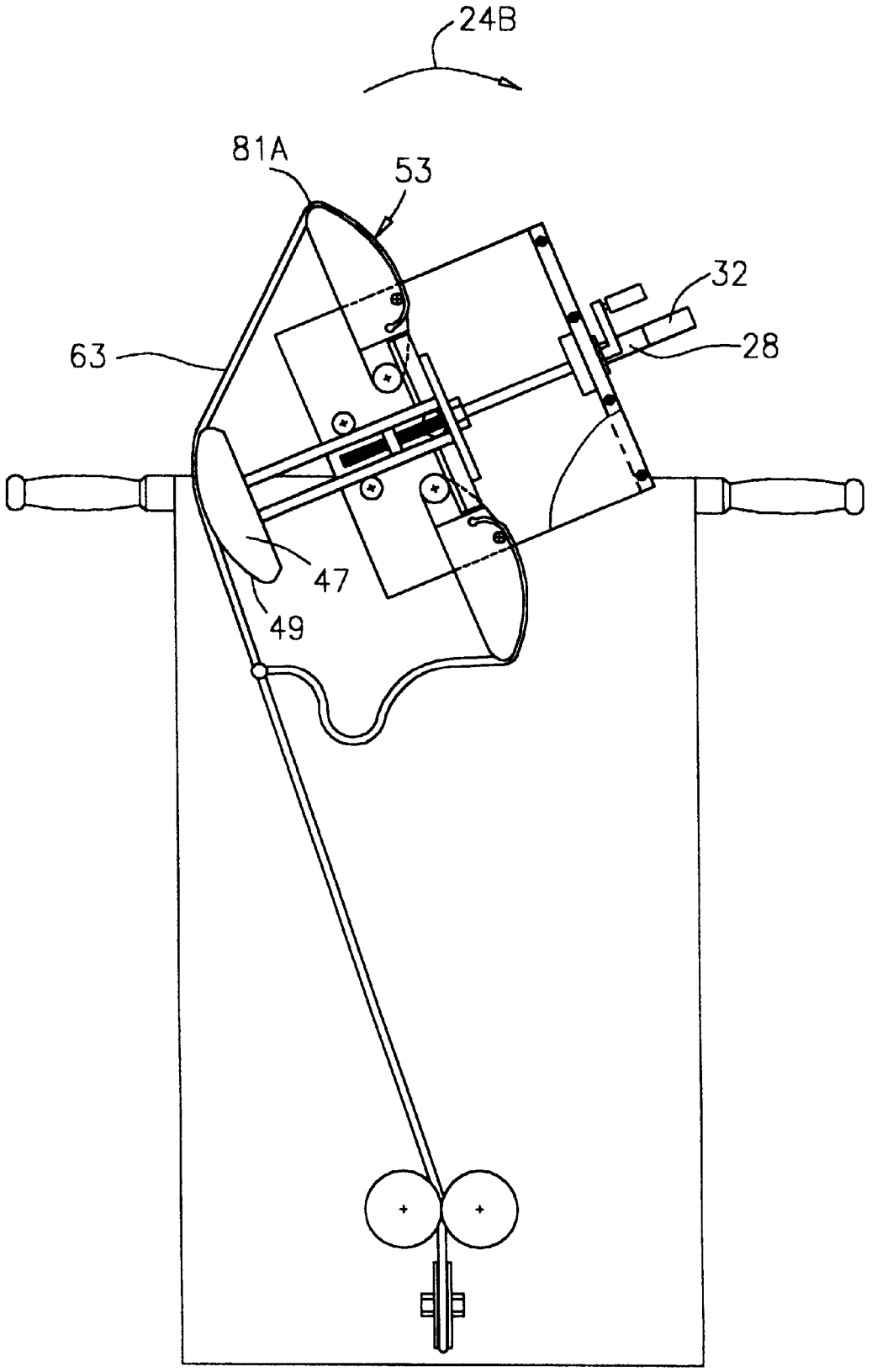
FIG. 8 is a front view of the machine adjusted to the configuration of FIG. 7 in operation to lift the weight.

In FIG. 8, the carrier 23 has been rotated in the direction of arrow 24B. As the carrier rotates, the block 47 contacts the cord 63. The block arcuate surface 49 keeps the same distance of the cord 63 from the axis of rotation 21 as the point 81A of the lever 53. The resisting torque on the carrier is thus constant as the carrier rotates, and the force from the weight is felt to be smooth and continuous to the user throughout carrier rotation.

By turning the crank 35, the positions of the levers 53 and 54 can be adjusted in very small increments to suit the user's exercise needs. By turning the crank in the opposite direction such that the slide 39 moves toward the top of the carrier 23, the weight 77 acting through the cords 63, 65, and 69 pivots the levers back toward their positions of FIGS. 1–6.

In summary, the results and advantages of increased arm strength can now be more fully realized. The weight lifting machine 1 provides both constant resistance to arm pivoting during an exercise cycle as well as fine adjustments to the resistance required to be overcome by the user. This desirable result comes from using the combined functions of the slide 39. The slide is moveable to pivot the levers 53 and 54 in small increments. Pivoting the levers causes the points of contact 81, 81A of the levers with the cords 63 and 65 to vary in distance from the carrier axis of rotation 21. The torque required to be exerted by a person to rotate the carrier varies proportionally. For a given lever position, the resisting torque produced by the weight 77 on the carrier remains constant throughout carrier rotation. As the carrier rotates, the block 47 on the slide comes into contact with the cord such that the carrier lifts the weight in a smooth manner. The block moves with the slide to assure that, for a given lever position, the resisting torque remains constant during carrier rotation.

It will also be recognized that in addition to the superior performance of the weight lifting machine 1, its construction is such as to cost no more then traditional exercise machines. Also, because it is made of a simple design and with rugged components, it gives long service life with minimal maintenance.

Thus, it is apparent that there has been provided, in accordance with the invention, a weight lifting machine that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A method of exercising arm muscles comprising the steps of:

a. producing equal and opposite torques on a rotatable carrier by pivotally connecting first and second levers on the carrier symmetrical about a carrier axis of rotation, providing first and second cords each having first and second ends, attaching the first ends of the cords to the first and second levers, respectively, at equal distances from the carrier axis of rotation, attaching the second ends of the first and second cords to a junction located vertically below the carrier axis of rotation, and hanging a weight from the junction of the first and second cords; and b. exerting a force by a person's arm on the carrier sufficient to overcome a selected one of the torques and thereby rotating the carrier in a first direction.

2. The method of claim 1 wherein the step of exerting a force and thereby rotating the carrier comprises the steps of:

a. revolving the first lever to a higher elevation relative to the axis of rotation and pulling the first cord to a higher elevation and thereby lifting the weight with the first cord; and b. revolving the second lever to a lower elevation relative to the axis of rotation and creating slack in the second cord such that the weight is lifted only by the first cord.

3. The method of claim 2 wherein:

a. the step of pivotally connecting first and second levers comprises the steps of:

i. pivotally connecting first and second levers each having an arcuate periphery and first and second ends; and ii. providing a block on the carrier for rotation therewith and having a periphery that is concentric with and is a continuation of the peripheries of the first and second levers and having opposite ends proximate the first ends of the respective levers;

b. the step of attaching the first ends of the first and second cords comprises the step of contacting the first and second cords with portions of the peripheries of the first and second levers, respectively;

c. the step of exerting a force and thereby rotating the carrier comprises the steps of:

i. contacting the first cord simultaneously with the first lever periphery and the block periphery while the first lever is revolving to a higher elevation; and ii. lifting the weight by the first cord smoothly around the block periphery and thereby preventing shock forces on the person's arm as the carrier and block rotate.

4. A method of exercising arm muscles comprising the steps of:

a. producing equal and opposite torques on a rotatable carrier, wherein the step of producing equal and opposite torques comprises the step of hanging first and second cords with a weight tied thereto at equal distances from a carrier axis of rotation, wherein the step of hanging first and second cords comprises the steps of:

i. providing first and second levers on the carrier symmetrical about the axis of rotation; and ii. hanging the first and second cords from the first and second levers, respectively;

b. pivoting the levers to a first position whereat the cords hang from the levers at first equal distances from the axis of rotation and thereby producing first equal and opposite torques on the carrier;

c. pivoting the levers to a second position whereat the cords hang from the levers at second equal distances from the axis of rotation and thereby producing second equal and opposite torques on the carrier; and d. exerting a force by a person's arm on the carrier sufficient to overcome a selected one of the torques and thereby rotating the carrier in a first direction, so that the person exerts a first force to rotate the carrier when the levers are in the first position thereof and a second force to rotate the carrier when the levers are in the second position thereof.

5. The method of claim 4 wherein the step of pivoting the levers to the first and second positions comprises the step of moving a slide on the carrier between a first location whereat the levers are in the first position and a second location whereat the levers are in the second position.

6. The method of claim 5 wherein:

a. the step of moving a slide comprises the step of moving a block with the slide; and b. the step of rotating the carrier in the first direction comprises the step of contacting the block with the first cord as the carrier rotates and lifting the weight by the first cord smoothly around the block.

7. The method of claim 4 wherein the step of exerting a force comprises the steps of:

a. exerting a first force sufficient to produce a torque equal to double the first torque to rotate the carrier when the levers are in the first position thereof; and b. exerting a second force sufficient to produce a torque equal to double the second torque to rotate the carrier when the levers are in the second position thereof.

* * * * *